United States Patent [19]

Oleszak

[11] 4,354,863

[45] Oct. 19, 1982

[54] FALSE CEILING

[76] Inventor: Johann Oleszak, Schleiermacherstrasse 25, D-4630 Bochum 6, Fed. Rep. of Germany

[21] Appl. No.: 212,428

[22] Filed: Dec. 3, 1980

[30] Foreign Application Priority Data

Dec. 7, 1979 [DE] Fed. Rep. of Germany ..... 2949235

[51] Int. Cl.[3] ..... B01D 45/08; B01D 53/00; F23J 11/02

[52] U.S. Cl. ..... 55/436; 55/446; 55/464; 55/DIG. 36; 98/40 D; 126/299 D; 126/299 F; 52/473

[58] Field of Search ..... 55/436, 440, 445, 446, 55/464, DIG. 36; 98/40 D, 121 R; 126/299 C, 299 D, 299 F; 52/473

[56] References Cited

U.S. PATENT DOCUMENTS

| | | | |
|---|---|---|---|
| 3,075,337 | 1/1963 | Andreae | 55/446 |
| 3,984,505 | 10/1976 | Gutermuth et al. | 55/DIG. 36 |
| 4,008,060 | 2/1977 | Andreae | 55/446 |
| 4,099,948 | 7/1978 | Gutermuth et al. | 55/440 |

FOREIGN PATENT DOCUMENTS

| | | | |
|---|---|---|---|
| 2411705 | 9/1975 | Fed. Rep. of Germany | 98/121 R |
| 522879 | 6/1940 | United Kingdom | 55/436 |

*Primary Examiner*—David L. Lacey
*Attorney, Agent, or Firm*—Salter & Michaelson

[57] ABSTRACT

A false ceiling for use in removing and/or dissipating contaminants in a room including a plurality of ceiling elements, each of which has an arcuate configuration, the concave surface of which is directed downwardly, and the convex surface of which is directed upwardly, the ceiling elements collecting and draining off contaminants in the form of condensate into collecting channels which are supported by support members on which the ceiling elements are also supported, the ceiling elements being defined by spaced apart parallel arcuate walls that define an air circulating passage therebetween, a plurality of spaced openings being formed in each of the walls to permit the free flow of air therethrough, the location of the openings in one of said walls being staggered relative to the location of the openings in the other of said walls.

3 Claims, 5 Drawing Figures

FALSE CEILING

Figure 1:
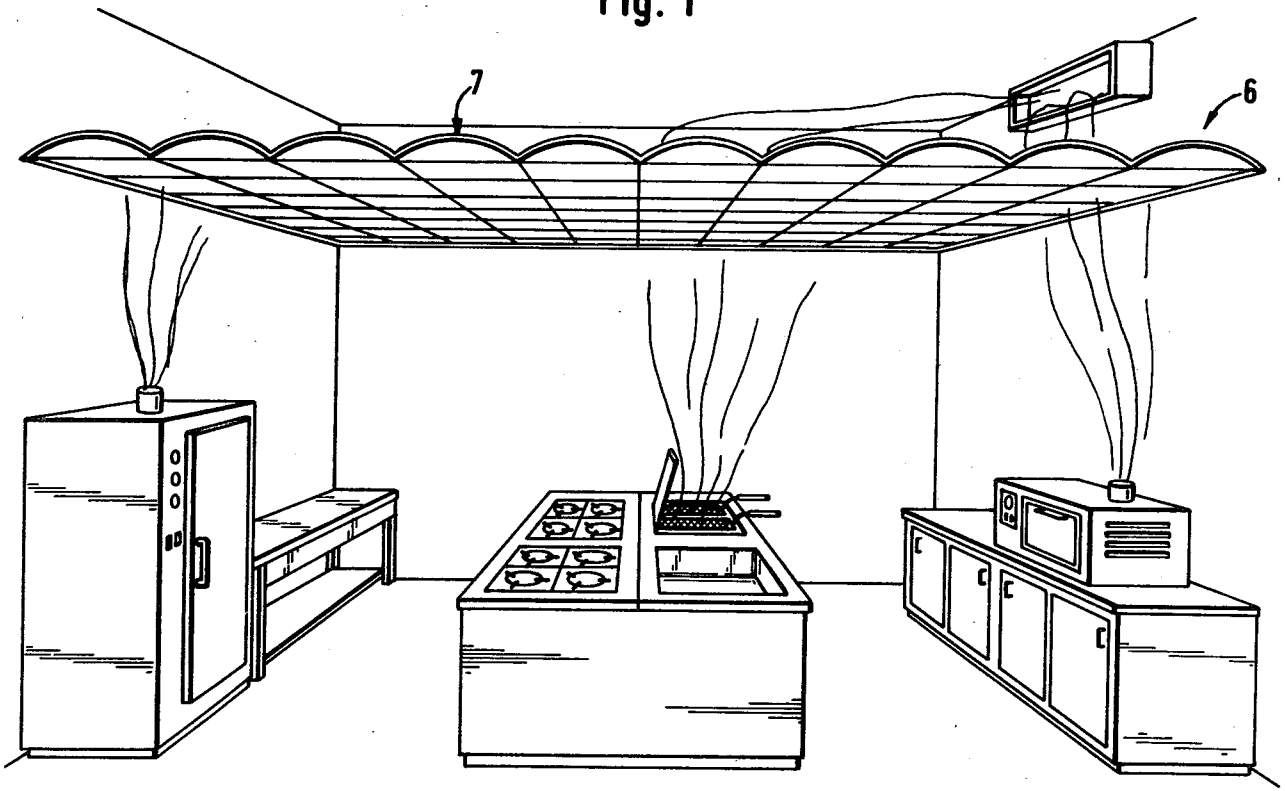

This invention relates to false ceilings for rooms containing contaminated air and, in particular, for fooms with steam, fatty vapors, suspended particles or other contaminants in the air, such as may be found in kitchens.

False ceilings have been proposed which include an array of ceiling elements of concave shape with their concave surfaces directed downwardly. The edges of the elements extend towards collecting channels which open upwards to receive contaminants drained from the elements. The collecting channels are fixed to cross members at the junctions of the elements and the cross members are suspended from the ceiling of the room.

Such false ceilings serve to separate out the contaminants in the air and to improve their separation it has been proposed to spray the undersurface of the elements with a film of water which then drains from the outer edges of the elements into the collecting channels. In this arrangement the channels must be leakproof to drain away the accumulated amounts of water.

With known false ceilings the air, after contacting the surface of the elements, passes between the edges of the individual elements and the walls of the collecting channels. Owing to the diversion of the air in this region, an expansion of the air takes place and further condensation and deposition of contaminants takes place. Care must be taken that the space through which the air passes does not become too constricted or closed by the collection of the deposits in the channels. Even a constriction of the ventilating space causes a lowering of the effectiveness of the ceiling and steam and vapor collect beneath the false ceiling and contaminate large areas of the ceiling. It is therefore necessary to take the false ceiling or its component parts down from time to time for cleaning in order to avoid a reduction in the ventilating space. If maintenance is unsatisfactory then the false ceilings will cease to function effectively.

Known false ceilings capable of removing contaminants also have the disadvantage of not improving the acoustics of the room. False ceilings are often installed in kitchens and canteens in which there is much noise. Since the ceilings are made of thin steel plate for hygienic reasons they do not adequately deaden the noise in the room. Attempts to solve this problem by using sound absorbing materials have failed because such materials get dirty and are almost impossible to clean thereby leading to unsatisfactory hygiene conditions.

An object of the invention is to provide an easily cleaned and acoustically effective false ceiling in rooms with contaminated air, the ceiling having improved operational characteristics, even with inadequate maintenance.

According to the invention a false ceiling for rooms containing contaminated air comprises an array of ceiling elements of concave shape with their concave surfaces directed downwards, upwardly directed collecting channels arranged to receive contaminants separated from the air and draining from the elements into the channels, and cross members located at the junctions of the ceiling elements and serving to support the false ceiling by suspension from the cross members, the collecting channels being detachably secured to the cross members from below, and the ceiling elements being of double-walled construction having spaced apart walls and air holes in the walls, the air holes in opposite walls being staggered relative to one another.

The separating and ventilating functions of the false ceiling reside in the ceiling elements which have air holes facing upwards and downwards and air passages between the holes. The rising air carrying contaminants first meets the walls of the elements facing downwards and part of the contaminants in the form of vapors and steam is precipitated and is conveyed as condensate to the edges of the elements and into the collecting troughs. The main air stream flows through the air holes in the walls of the elements facing downwards, into the spaces between the walls. Expansion of the air takes place in passing into the spaces giving rise to further condensation of the contaminants. At the same time the air is deflected due to the staggered arrangement of the holes in opposite walls of the elements. Accordingly suspended particles and other contaminants are separated out in this region.

Within the spaces in the elements, which are larger than the equivalent spaces in known ceilings, the air comes into contact with the inner surfaces of the walls of the elements which face upwards. The main condensation action takes place in this region because the air expands in passing through the holes in the lower walls of the elements and the upper walls of the elements are somewhat colder than the lower walls.

Preferably the air holes are each formed with a flange extending into the space between the walls. Consequently the condensate between the walls of the elements is conveyed through the space without dripping back through the air holes. Moreover the flanges offer a more attractive shape to the elements and better sound absorption is achieved. Greatly enhanced sound absorption is obtained with the ceiling elements of the invention. Simple concave ceiling elements achieve a certain reduction in noise but the provision of air holes brings about a decisive improvement. The improvement in acoustics does not impair the other functional qualities of the ceiling or its hygienic qualities.

Advantageously the ends of the collecting channels are clipped on to corresponding projections on the cross members.

Conveniently the collecting channels each have end walls to form a collecting trough. However it is important that the collecting channels do not perform any ventilating function so that inadequate cleaning of the channels does not affect the functioning of the ceiling even if the channels are overfilled. If it is desired to dispense with having to clean the channels at intervals, overfilling of the channels can be avoided by incorporating the channels in an interconnected channel system which is continuously drained.

The cross members may be fixed in position by the corners of the ceiling elements and by the collecting channels attached to the cross members. It is important that the ceiling elements and the collecting troughs can be independently removed and independently cleaned. So long as not all the elements and troughs are removed from a cross member at one time, the cross members may remain fixed in position.

Cleaning of the ceiling elements is particularly simple if the ceiling elements each include two walls spaced apart and joined detachably to one another, the edges of the walls being located relative to one another by spacers. The walls can then be separated and thoroughly cleaned inside and out in, for example, an industrial washing machine. The spacers provide an easily releasable compression joint between the walls, retaining the space between the walls.

The joining arrangement of the walls to make up a ceiling element makes it possible to replace the upwardly facing wall of the element with a closed wall i.e. without air holes, if the elements are provided in a part of a room which are to be ventilated less than other parts or a part to be unventilated. Such parts of a room are always present in, for example canteens, and known ceilings have means for closing the ventilation passages for this purpose. With the present ceiling the closing of ventilation passages is particularly evident so mistakes due to inadvertent closing of ventilation passages cannot occur.

Figure 2:
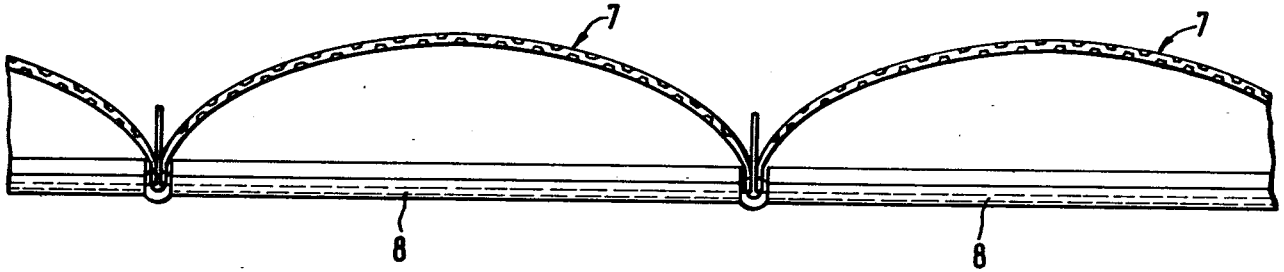
Figure 3:
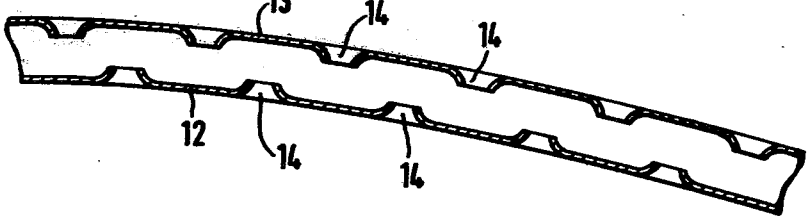
Figure 4:
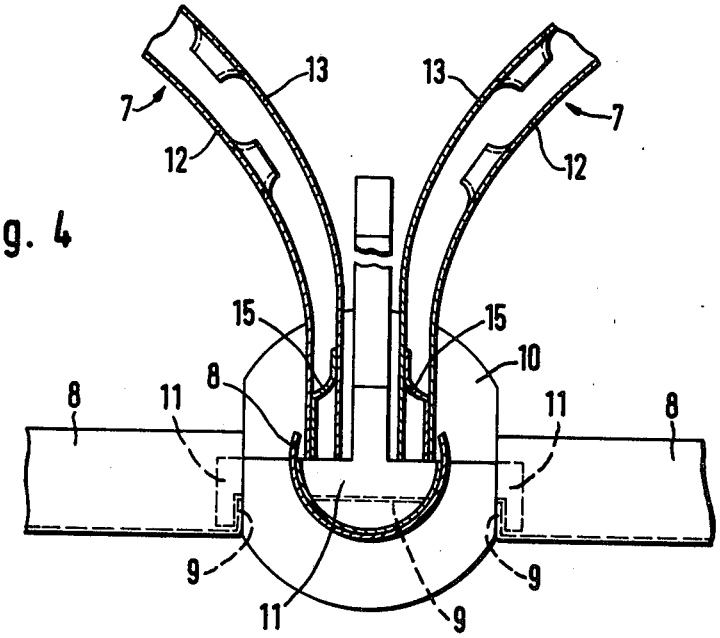
Figure 5:
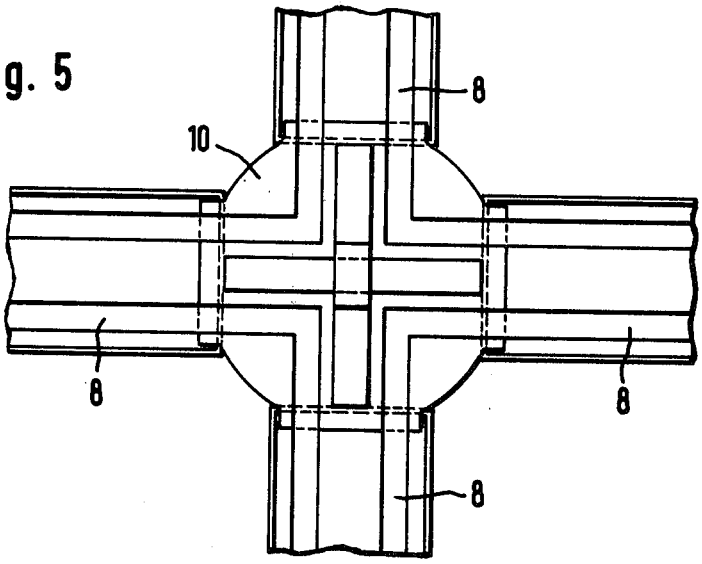

Further features of the invention will appear from the following description of an embodiment of the invention given by way of example only and with reference to the drawings, in which:

FIG. 1 is a perspective view of a canteen or kitchen with a false ceiling according to the invention, FIG. 2 is a cross-section through part of the ceiling of FIG. 1, FIG. 3 is a cross-section through part of a ceiling element, FIG. 4 is a cross-section through the ceiling in the region of a junction between ceiling elements, and FIG. 5 is an underplan view of a junction between ceiling elements.

Referring to the drawings, in FIG. 1 a kitchen has a false ceiling 6 which is suspended from the room ceiling and includes ceiling elements 7 which are each of concave shape with the concave surface directed downwards. The elements 7 are arranged in a regular array such that the elements are in parallel rows to cover the ceiling area.

Referring to FIGS. 2 and 4 it can be seen that the edges of the elements 7 extend into collecting channels 8 with an upwardly extending opening. The channels 8 have end walls 9 to form closed troughs which can be easily removed from cross members 10 for cleaning in, for example, a washing machine.

The fastening of the collecting troughs 8 to the cross members 10 is simply achieved by clipping the side walls of the troughs 8 on to corresponding retaining projections 11 of the cross members. The end walls 9 engage in a corresponding slot in the projection 11 as shown in FIG. 4. FIG. 5 shows such a connection between a cross member 10 and the troughs 8 and indicates the pleasing visual appearance presented to the room and also the possibility of uniting the troughs via the cross members to form a conduit system whereby the condensate can be drained away. In this way less frequent maintenance operations need to be performed.

In FIG. 3 there is seen the construction of the ceiling elements. The elements each have a wall 12 facing downwards and spaced from a wall 13 facing upwards. Both walls 12 and 13 are formed with air holes around which are formed flanges projecting into the space between the walls. The flanges make the elements visually attractive and they displace the expansion area of air passing through the holes into the interior of the elements to improve separation efficiency. The flanges are shaped so that condensate within the elements flows to the edges of the elements and does not accumulate in the elements.

It is an advantage if the walls 12 and 13 are detachably secured to one another. As shown in FIG. 4 this is achieved by means of spacers 15 which are attached towards the edges of the walls 13 and have elastic shanks. The other walls 12 of the elements are pushed against the shanks and are joined detachably by simple clamp fittings to the wall 13 to form the elements.

What I claim as my invention and desire to secure by Letters Patent of the United States is:

1. A false ceiling for use in removing and/or dissipating contaminants including condensible contaminants in a room comprising:

a. a plurality of ceiling panels of arcuate configuration, the concave surfaces of which are directed downwardly, each of said panels being substantially defined by a pair of spaced apart substantially parallel lower and upper walls which define a substantially unobstructed continuous open passage in each of said panels, each of said lower and upper walls having spaced openings therein to permit the flow of air in said passages, said openings having flanges therearound which extend inwardly in the respective panels thereof, the openings in one of said walls being in staggered relation to the openings in the other of said walls, whereby air passing through said panels is deviated in its flow in said passages and contaminants from said air condensing on the inner surfaces of said walls gravitate downwardly in substantially continuous flow through said passages and are prevented from passing through the openings in said lower walls by said flanges;

b. a plurality of collecting channels adjacent the lower edges of said panels in communication with the respective passages thereof for receiving said condensed contaminants for disposition thereof; and c. a plurality of support members for supporting said panels at the corners thereof and for detachably supporting said channels to permit the removal thereof for cleaning.

2. A false ceiling as claimed in claim 1, each of said collecting channels further including end walls joined thereto so as to define collecting troughs for receiving the contaminants in the form of condensation therein.

3. In the false ceiling of claim 1, further including means detachably securing the upper and lower walls of each of said panels together so that they can be detached from each other to facilitate the cleaning thereof.

* * * * *